US006193392B1

(12) United States Patent
Lodhie

(10) Patent No.: US 6,193,392 B1
(45) Date of Patent: Feb. 27, 2001

(54) LED ARRAY WITH A MULTI-DIRECTIONAL, MULTI-FUNCTIONAL LIGHT REFLECTOR

(76) Inventor: Pervaiz Lodhie, 14 San Clemente Dr., Rancho Palos Verdes, CA (US) 90275

( * ) Notice: Subject to any disclaimer, the term of this patent is extended or adjusted under 35 U.S.C. 154(b) by 0 days.

(21) Appl. No.: 09/322,807

(22) Filed: May 27, 1999

(51) Int. Cl.[7] ..... F21V 7/00
(52) U.S. Cl. ..... 362/235; 362/301; 362/800
(58) Field of Search ..... 362/235, 247, 362/301, 800, 545, 555

(56) References Cited

U.S. PATENT DOCUMENTS

| | | | | |
|---|---|---|---|---|
| 4,011,931 | | 3/1977 | Wyckoff | 194/4 |
| 4,310,885 | | 1/1982 | Azcua et al. | 364/405 |
| 4,367,760 | | 1/1983 | Thomas et al. | 133/4 |
| 4,682,768 | | 7/1987 | Iida et al. | 271/3.1 |
| 4,812,814 | * | 3/1989 | Elliott | 362/800 X |
| 4,966,304 | | 10/1990 | Kelly | 221/6 |
| 5,119,174 | * | 6/1992 | Chen | 362/800 X |
| 5,616,915 | | 4/1997 | Simpkins et al. | 250/221 |
| 5,855,268 | | 1/1999 | Zoladz | 194/207 |

* cited by examiner

*Primary Examiner*—Stephen Husar
(74) *Attorney, Agent, or Firm*—Lyon & Lyon LLP

(57) ABSTRACT

A light source particularly suited for a display in a dispensing machine. The light source includes an array of light emitting diodes (LEDs) mounted on a printed circuit board (PCB) with a multi-directional, multi-functional reflector disposed about the PCB. The reflector reflects the LED light in multi-directions and serves to provide a more uniform light intensity throughout the illuminated surface. The reflector also encloses the total light radiation to a predefined surface area.

15 Claims, 7 Drawing Sheets

LED ARRAY WITH A MULTI-DIRECTIONAL, MULTI-FUNCTIONAL LIGHT REFLECTOR

TECHNICAL FIELD

The present invention broadly relates to the field of lighting sources for dispensing machines, particularly gaming machines and specifically to the use of Light-Emitting Diode LED) Arrays as light sources for such machines.

BACKGROUND OF THE INVENTION

Dispensing machines need a variety of light sources, including optical sensing to discriminate the currency bills being fed into the dispensing machine, indicating the status of whether a particular product is available, displaying instructions for operating the dispensing machine, including how a currency bill should be inserted, or displaying an advertisement of the product or trade name.

Although incandescent light bulbs are currently popular light sources for dispensing machines, there are some inherent shortcomings in their application. Thus, there is a need to find a different light source for dispensing machines. For example, the incandescent bulb's life expectancy is quite short in comparison to that of a Light Emitting Diode (LED) which can be expected to last approximately five to ten times longer. Therefore, there would be a reduction in replacement labor costs if LEDs were used as the light sources.

LEDs are much more efficient at converting electrical power into usable light. This is because LEDs are monochromatic; they emit light within a very narrow set of wavelengths rather than waste power emitting light over a wide frequency spectrum. This characteristic makes an LED light source an energy saving device which saves money in electric bills. In gaming casinos where there are thousands of dispensing machines such as gaming machines and money changing machines, the total energy savings can be significant.

The power conversion inefficiency of incandescent lights contributes to the problem of heat damage to surrounding components and the housing structure of the light. Since a relatively large quantity of input power into the incandescent light is not converted into usable light, the unusued power dissipates as heat to the light's surroundings. In its application to dispensing machines where the light source is usually enclosed, heat damage to surrounding components, such as melted plastic parts, dried-up electrical wires, etc., or to the housing structure is more probable. LEDs, with their much lower power requirements and their more efficient power conversion eliminates some heat damage by its reduction in heat emittance.

Also, unlike the incandescent bulb which typically uses a metal filament placed inside a glass bulb, the LED is constructed out of semiconductor materials which are extremely rugged. Dispensing machines are frequently subject to abuse by its users. In particular, it is not uncommon for a user to hit a dispensing machine because the wrong change or the wrong product was delivered. And, an angry gambler's fist may delivere blows to a gaming machine, causing the metal filament or the glass bulb of an incandescent light to break. In dispensing machines with large quantities of cash, vandalism acts such as trying to kick open the machine are likely to cause the incandescent light to break. There are several more advantages to using LEDs as the light sources of dispensing machines. Only a few are mentioned above.

The above-mentioned shortcomings are overcome by the present invention as discussed hereafter.

SUMMARY OF THE INVENTION

The present invention is directed to an array of LEDs mounted on a printed circuit board (PCB) with a multi-directional, multi-functional reflector disposed on the PCB. The reflector reflects the light into multi-directions and also encloses the total light radiation to a pre-defined surface area. In one embodiment, the reflector is sandwiched between the LEDs and the PCB.

The LEDs are mounted on a PCB. In one embodiment, voltage regulators and resistors are also mounted on the PCB to convert the voltage and current intended for use with an incandescent light into a form suitable for the LEDs. The PCB is etched with electrically conductive material on at least one surface, electrically integrating the LEDs with the voltage regulators and resistors mounted on the PCB. In other embodiments, the electronic components may also include (but is not limited to) voltage surge protectors, capacitors and transistors. The type and quantity of the electronic components necessary for a particular LED array is determined by the desired electrical characteristics of that LED array. The type and quantity of the electronic components shown in the figures are for illustration purposes only and are not indicative of the only type and/or quantity of the electronic components associated with the different embodiments presented in the present application or of other embodiments of the present invention that can be fabricated and be within the spirit and scope of the appended claims.

The present invention also includes a multi-directional, multi-functional reflector. The reflector is made from a single piece of lightweight material and comprises a flat main section and a plurality of flap sections surrounding the main section. In one embodiment, the flap sections are bent at 90 degree angles from the main section. Other angular relationships are also possible depending on structural surroundings. The main section also includes cut-outs where the LEDs are inserted through. The main section and each of the flap sections reflect light from a particular LED in different directions, depending on the geometrical relationship of that particular LED and each of the reflector sections. The specific reflection pattern is well known to persons skilled in the art for a given angular relationship between the LED and a reflector section. Additionally, the flap sections serve to confine the illumination from the LEDs to a predefined area or surface.

The reflector also serves to provide a more uniform light intensity throughout the illuminated surface. Without the reflector, each LED correspondingly lights up a discrete spot on the illuminated surface. Thus, the luminance projected by the discrete number of LEDs will not appear to be uniform to the viewer, and there will be an overall "spotty" appearance with portions of the surface having a higher light intensity than other portions.

The reflector of the present invention can also be used with incandescent bulbs. Incandescent bulbs have even a greater problem of "spotty" appearances. The power conversion inefficiency of incandescent bulbs causes the illumination pattern of an incandescent bulb to be very bright in the center and dramatically less bright in the surrounding areas. The reflector of the present invention can help temper the dramatic change in brightness between the center and the surrounding areas.

Accordingly, one of the objects of the invention is to provide a light source with uniform light intensity throughout the display surface.

It is the further object of the invention to provide a light source that reduces power consumption.

Another object of the invention is to provide a light source that reduces heat emittance.

Another object of the invention is to provide a light source that is rugged.

Another object of the invention is to provide a light source with long life expectancy.

Other and further objects and advantages of the present invention will be further understood and appreciated by those skilled in the art by reference to the following specification, claims and drawings.

BRIEF DESCRIPTION OF THE DRAWINGS

Similar reference characters denote corresponding features consistently throughout the drawings.

DETAILED DESCRIPTION OF THE INVENTION

Figure 1A:
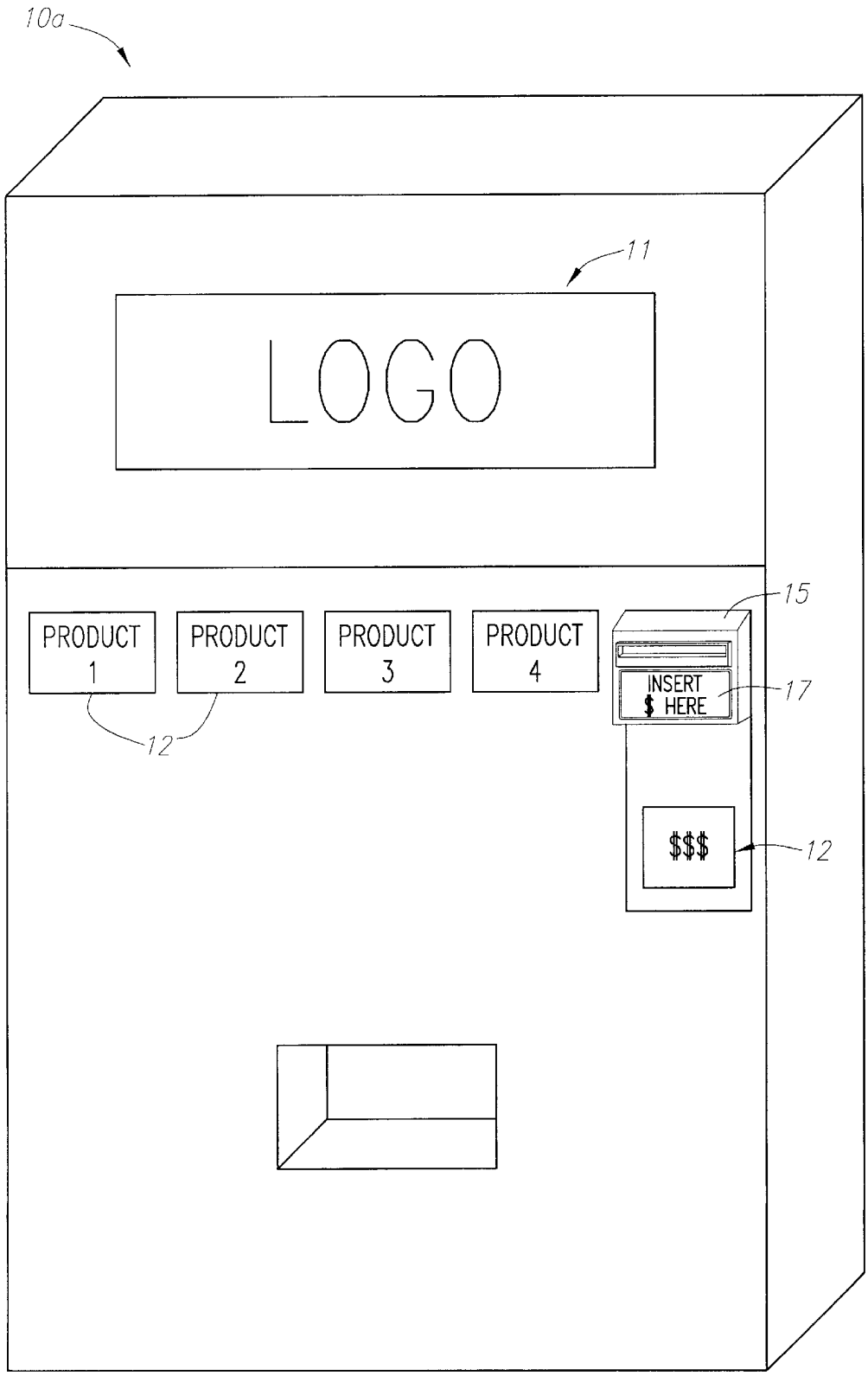
Figures 1A & 1B are perspective views showing two typical dispensing machines, a gaming machine and a vending machine, that require various illuminating light sources such as provided by the present invention.
Figure 1B:
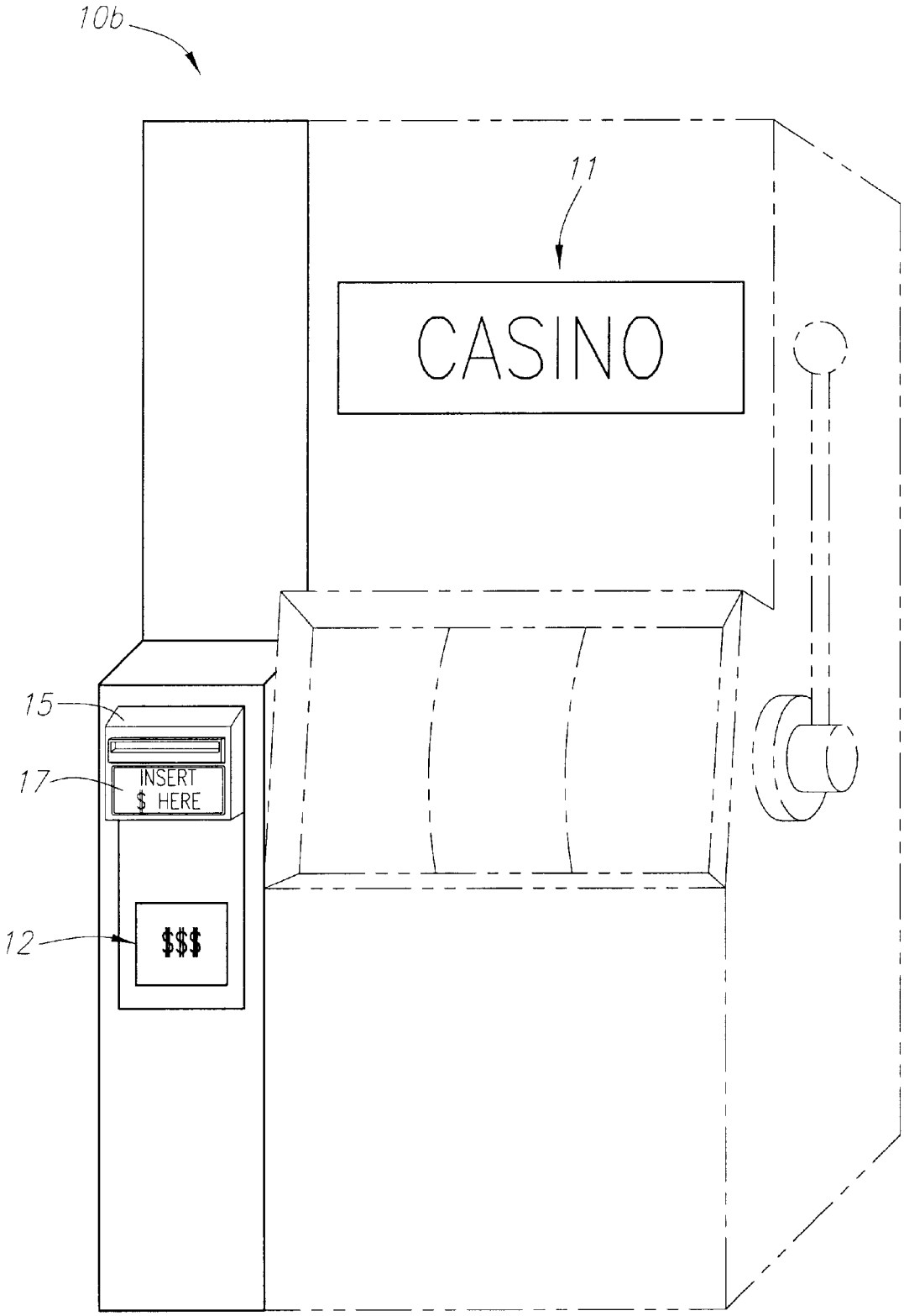

FIGS. 1A & 1B show two typical dispensing machines, a vending machine 10*a* and a gaming machine 10*b*. In FIGS. 1A & 1B, lighting sources are needed to illuminate the advertisement displays 11, indicator displays 12, currency receiving sections 15, and instructional/status displays 17. The present invention is a particularly desirable light source for the aforementioned applications.

Figure 2A:
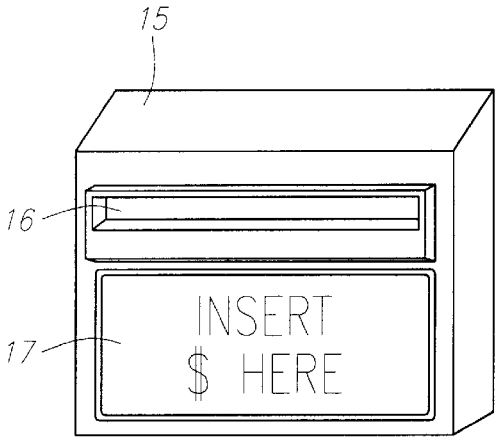
FIGS. 2A & 2B are perspective front and rear views, respectively showing the currency receiving sections of the dispensing machines shown in Figures 1A & 1B.
Figure 2B:
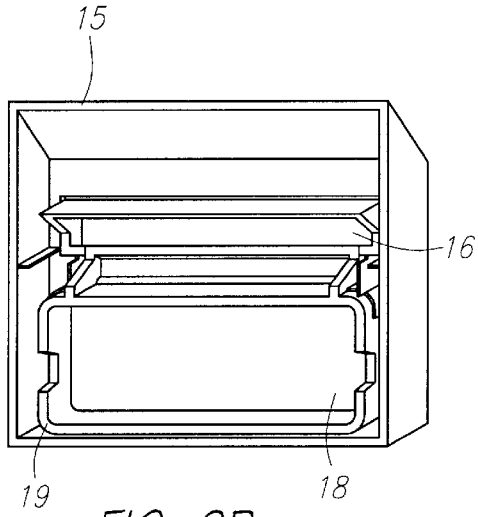
Figure 3:
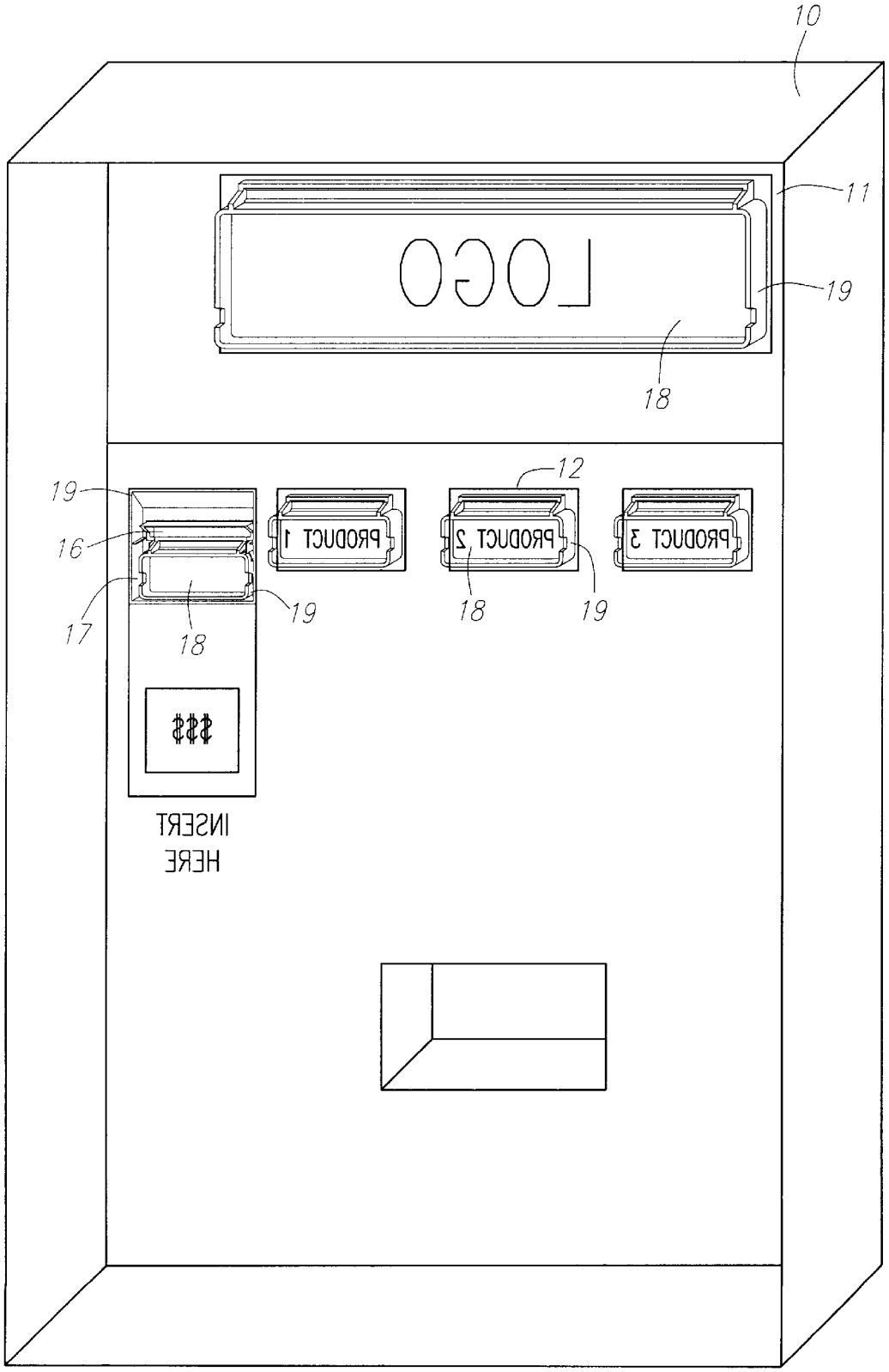
FIG. 3 is a perspective view from the inside of a dispensing machine looking out.

FIGS. 2A & 2B show the currency receiving section 15 of the dispensing machines 10*a* & 10*b*. The currency receiving section 15 comprises a bill insertion opening 16 and an instructional/status display 17. A dispensing machine typically utilizes optical, magnetic or other sensors to obtain measurements from the inserted currency to determine authenticity and denomination. Stray light from a light source for the nearby instructional/status display 17 may cause measurement errors for the currency sensors. In particular, an optical sensor may be especially sensitive to other light sources. In FIG. 2B, the backside of the currency receiving section 15 is shown with the instructional/status display opening 18 formed with a border 19. The border 19 marks the boundaries of the display opening 18 and provides structural support for mounting a light source 30 described below. FIG. 3 is a perspective view from the inside of a dispensing machine looking out. Again, each display opening 18 is provided with a border 19 that provides structural support for the light source.

Figure 4:
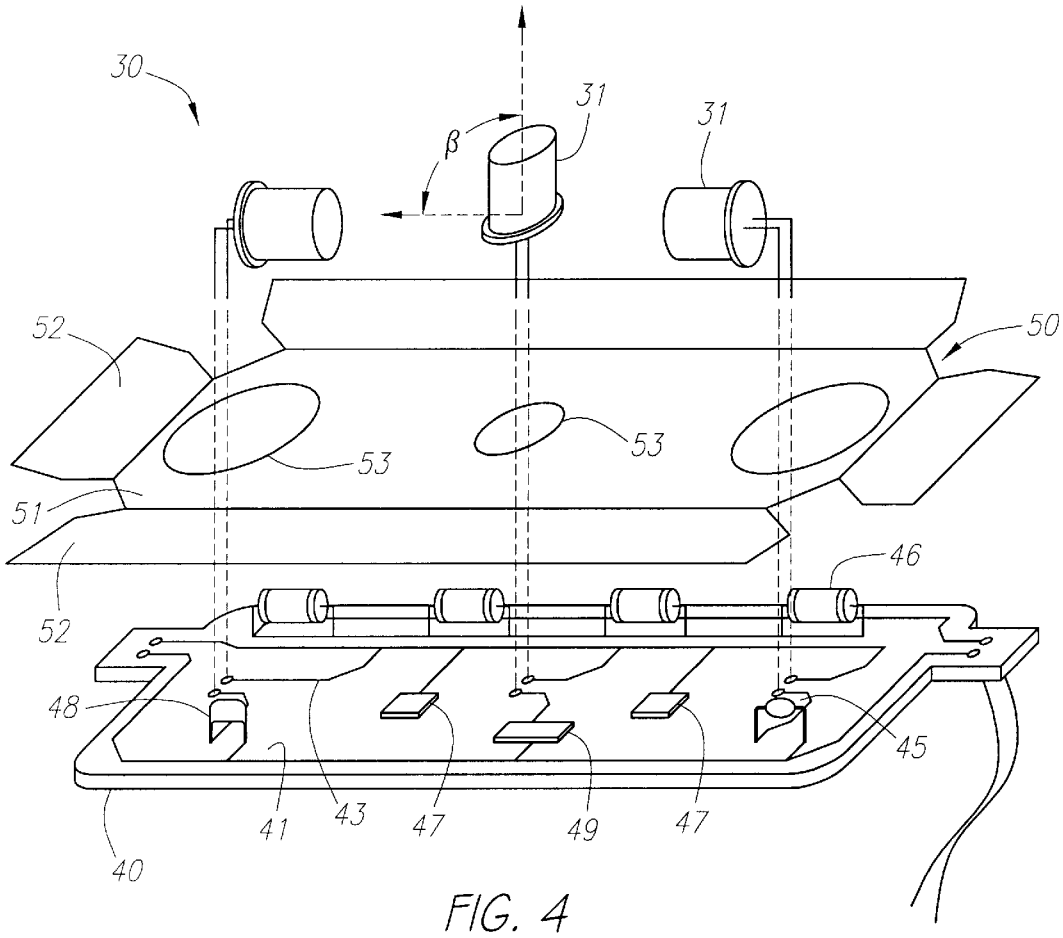
FIG. 4 is an exploded view of an array of LEDs and electronic components mounted on a printed circuit board (PCB) and a multi-directional, multi-functional reflector of this invention disposed on the PCB.

FIG. 4 is an exploded view of the light source 30 of this invention having an array of LEDs 31 and electronic components mounted on a PCB 40 and a multi-directional, multi-functional reflector 50 sandwiched between the LEDs 31 and the PCB 40. In one embodiment, voltage regulators 45 and resistors 46 are also mounted on the PCB to convert the voltage and current intended for use with an incandescent light into a form suitable for the LEDs 31. The PCB 40 is etched with electrically conductive material 43 on at least one surface 41, electrically integrating the LEDs 31 with the voltage regulators 45 and resistors 46 mounted on the PCB 40. In other embodiments, the electronic components may also include (but is not limited to) voltage surge protectors 47, capacitors 48 and transistors 49. The type and quantity of the electronic components necessary for a particular LED array is determined by the desired electrical and/or lighting characteristics of a particular light source and LED array.

Figure 5:
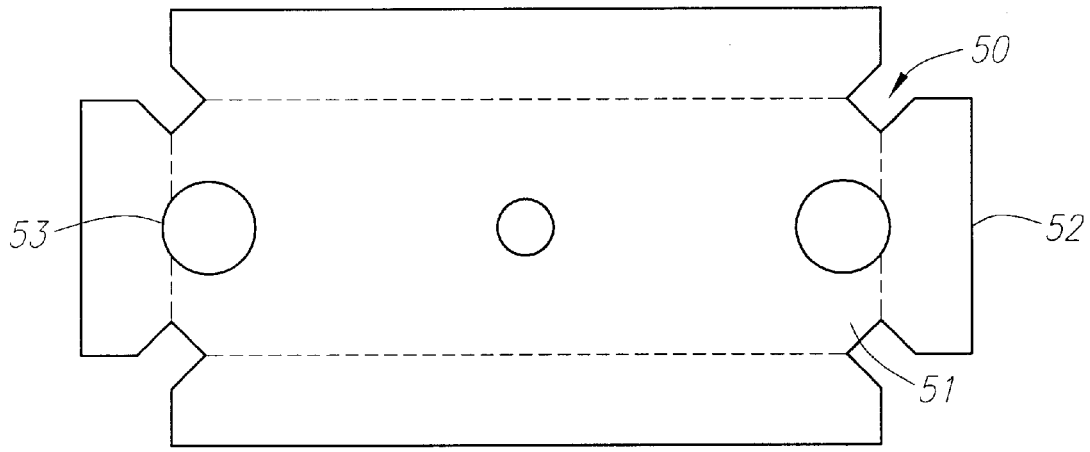
FIG. 5 is a plan view of a multi-directional, multi-functional reflector.
Figure 6A:
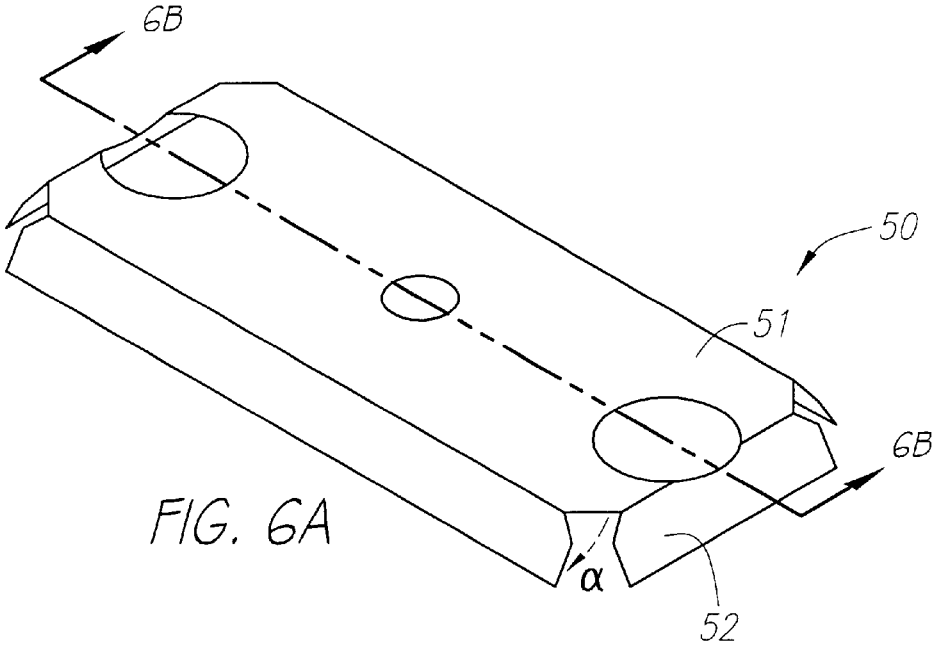
FIGS. 6A & 6B are perspective and elevation views, respectively, showing the angular relationship between the main section and the flap sections of the reflector.
Figure 6B:
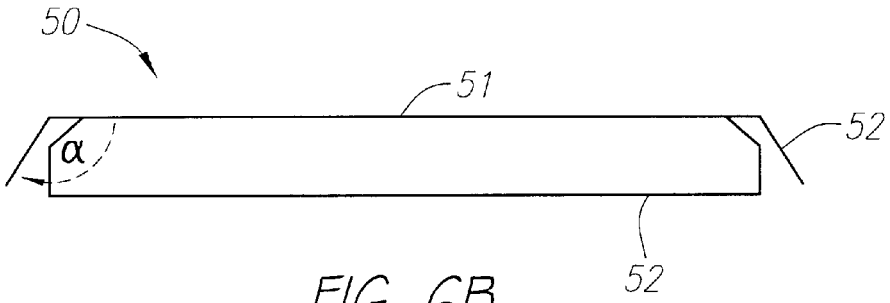

The reflector 50 is made from a single piece of lightweight material, such as paper, opaque plastic or the like, and comprises a flat main section 51 and a plurality of flap sections 52 surrounding the main section 51, as also shown in FIGS. 5, 6A and 6B. In one embodiment, the main section 51 comprises cutouts 53. The LEDs 31 are inserted through the cutouts 53 to sandwich the reflector between the LEDs 31 and the PCB 40. The shapes of the cutouts 53 may vary to correspond with the shapes of the LEDs 31. Although the drawings show three cutouts 53 on reflector 50, the number of cutouts 53 depends on the number of LEDs 31 in the array. In the alternative, slits (not shown) may be provided in the reflector 50 to allow the reflector 50 to be slid onto the PCB 40 under the LEDs 31 from the side, rather than providing full sized cutouts 53.

As shown in FIG. 4, the LEDs 31 may sit in a perpendicular position to the main section 51 or may be bent at an angle $\beta$. In a preferred embodiment using three LEDs 31, the center LED sits perpendicular to the main section 51 while the two peripheral LEDs sit approximately parallel to the main section 51.

As shown in FIGS. 6A & 6B, a flap section 52 is bent at an angle $\alpha$ as measured between the plane of the main section and the plane of the flap section. Each flap section 52 may be bent at a different angle $\alpha$ than the other flap sections of the reflector 50. In one embodiment, all the flap sections 52 are bent 90 degrees from the main section 51. The flap sections may be preformed to the desired bend angle and inserted into the display opening 18 where the border 19 supports the light source 30, or the junction of the main section 51 and each flap section 52 may be creased and the flat sections 52 caused to bend to the desired angle by engagement with the surrounding border 19 during installation. Such installation may also cause some degree of bending and curving of the main section 51 and the flap sections 52.

The main section 51 and each of the flap sections 52 reflect light from a particular LED 31 in different directions, depending on the geometrical relationship of that particular LED 31 with that particular reflector section. The reflector 50, with its multiple sections 51 & 52, serves to provide a more uniform light intensity throughout the area occupied by the reflector behind each illuminated display surface 11, 12 & 17. This is because some of the light rays are reflected by more than one section of the reflector, causing a diffusion of the light intensity. Thus, the luminance of the entire LED array appears more uniform to the viewer and eliminates the "spotty" appearance of higher light intensity on one area and lower light intensity on another area usually found with incandescent light sources. Additionally, since the flap sections 52 also act as boundaries to the light path, the flap sections also confine the luminance from the LED array to the display surface 11, 12 & 17.

The main section 51 of the reflector 50 need not be confined to a rectangular shape as shown in the drawings. In other embodiments, the main section could have a square shape, a circular shape, a trapezoidal shape or some odd shape. The criteria for determining the shape of the main section 51 is the shape of the display surface 11, 12 & 17.

Figure 7A:
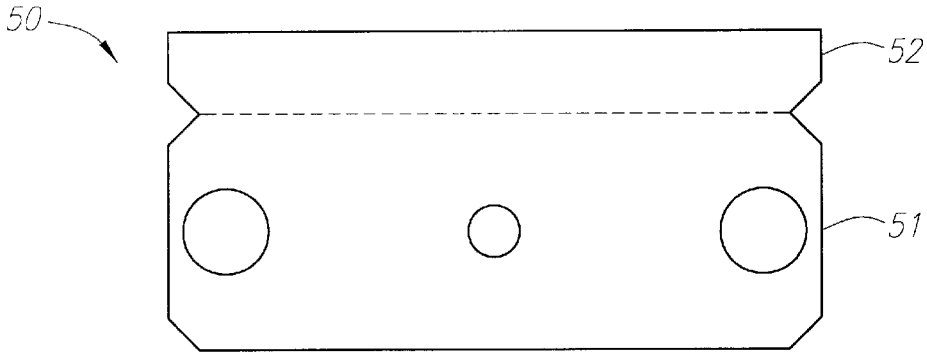
FIGS. 7A, 7B and 7C are plan views similar to FIG. 5 showing alternate embodiments of the multi-directional, multi-functional reflector.
Figure 7B:
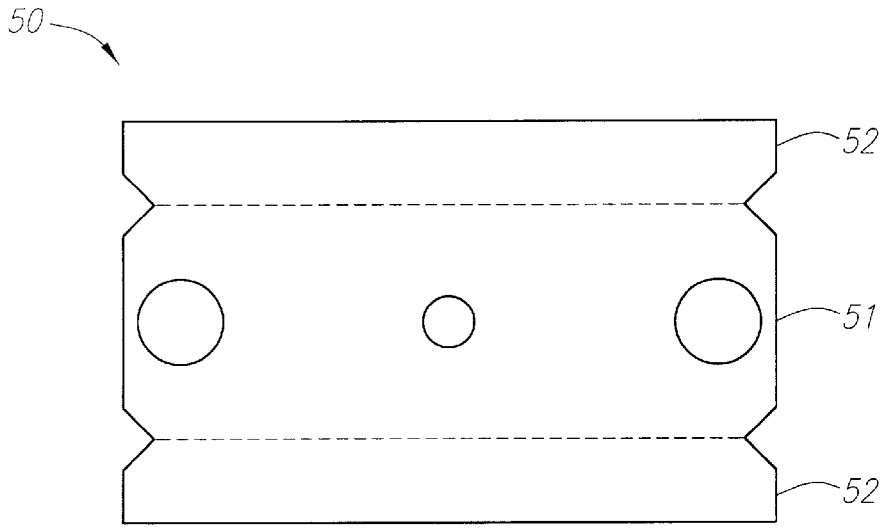
Figure 7C:
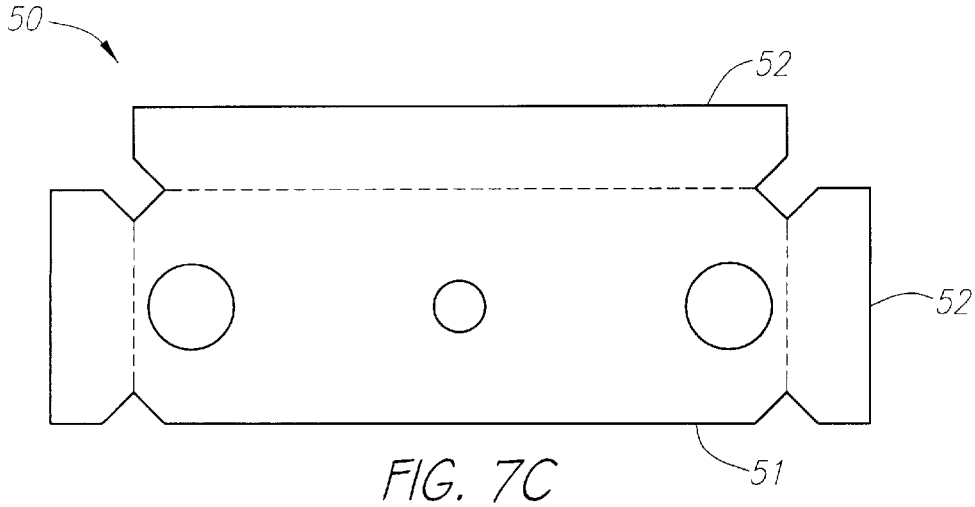

FIGS. 7A, 7B and 7C show other embodiments of the reflector 50 with varying flap sections 52.

Other aspects and objects of the invention will be apparent from the appended Figures and claims.

It is understood that other embodiments of the present invention can be fabricated and be within the spirit and scope of the appended claims.

I claim:

1. A light source comprising:

a printed circuit board;

a light emitting diode mounted on said printed circuit board; and a reflector disposed on said printed circuit board, said reflector having a flap surface and a planar surface for reflecting light from said light emitting diode.

2. The light source of claim 1 further comprising a resistor mounted on said printed circuit board.

3. The light source of claim 1 further comprising a voltage regulator mounted on said printed circuit board.

4. The light source of claim 1 further comprising a resistor and a voltage regulator mounted on said printed circuit board.

5. The light source of claim 1 wherein said planar surface is rectangular in shape.

6. The light source of claim 1 wherein said reflector planar surface is provided with means for allowing installation of said reflector onto said printed circuit board with said light emitting diode mounted on said printed circuit board.

7. The light source of claim 1 further including a display opening member having a border portion wherein said reflector fits into said display opening member and engages said border portion.

8. A light source comprising:

a printed circuit board;

at least three light emitting diodes mounted on said printed circuit board in spaced relationship;

a reflector disposed on said printed circuit board, said reflector having four flaps extending from a planar surface for reflecting light from said light emitting diodes.

9. The light source of claim 8 further comprising a resistor and a voltage regulator mounted on said printed circuit board.

10. The light source of claim 8 wherein at least two light emitting diodes are parallel to said planar surface.

11. The light source of claim 8 wherein a light emitting diode is perpendicular to said planar surface.

12. The light source of claim 10 wherein at least one light emitting diode is perpendicular to said planar surface.

13. A light source comprising:

a printed circuit board;

at least two light emitting diodes mounted on said printed circuit board; and a reflector disposed on said printed circuit board, said reflector having a flap section extending from a planar surface for reflecting light from said light emitting diodes.

14. The light source of claim 13 further comprising a resistor and a voltage regulator mounted on said printed circuit board.

15. The light source of claim 13 wherein at least one light emitting diode is parallel to said planar surface.

* * * * *